United States Patent [19]

Lynch et al.

[11] 4,233,122

[45] Nov. 11, 1980

[54] ELECTROLYTIC PROCESS FOR POTASSIUM HYDROXIDE

[75] Inventors: Richard W. Lynch, Chattanooga; Garland E. Hilliard; Ronald L. Dotson, both of Cleveland, all of Tenn.

[73] Assignee: Olin Corporation, New Haven, Conn.

[21] Appl. No.: 44,827

[22] Filed: Jun. 1, 1979

[51] Int. Cl.[3] ..... C25B 1/34

[52] U.S. Cl. ..... 204/98; 204/128

[58] Field of Search ..... 204/98, 128

[56] References Cited

U.S. PATENT DOCUMENTS 4,065,366 12/1977 Oda et al. ..... 204/98

*Primary Examiner*—R. L. Andrews

*Attorney, Agent, or Firm*—Gordon F. Sieckmann; Donald F. Clements

[57] ABSTRACT

Improved current efficiency is obtained in an electrolytic membrane cell for the production of potassium hydroxide by employing in combination:

(a) a membrane comprised of a carboxylic acid substituted polymer prepared by reacting a fluorinated olefin with a comonomer having a functional group selected from the group consisting of carboxylic acid and a functional group which can be converted to carboxylic acid;

(b) a potassium chloride brine feed through the anolyte chamber of the cell having a concentration in the range from about 250 to about 300 grams of potassium chloride per liter;

(c) a cell operating temperature in the range from about 90° to about 100° C.;

(d) producing a depleted brine in the anolyte chamber after electrolysis in which the potassium chloride consumed by electrolysis ranges from about 5 to about 15 percent by weight of the potassium chloride originally present in the brine feed, and (e) maintaining a catholyte potassium hydroxide concentration in the range from about 500 to about 600 grams potassium hydroxide per liter.

7 Claims, No Drawings

ELECTROLYTIC PROCESS FOR POTASSIUM HYDROXIDE

This invention relates to a process for the electrolytic production of chlorine and potassium hydroxide. Potassium hydroxide is used in the manufacture of soft soap, alkaline batteries, and in the production of textiles and the fabrication of rubber.

Commercially, potassium hydroxide is produced in electrolytic cells employing asbestos diaphragms as a product liquor containing 10–15 percent KOH and about 10 percent KCl. The liquor is concentrated by evaporation while crystallizing out KCl to provide a concentrated solution containing about 45 percent KOH and containing about 1 percent KCl.

U.S. Pat. No. 4,062,743, issued to Byung K. Ahn and Ronald L. Dotson on Dec. 13, 1977, discloses a process for improving the reactant efficiency in an electrolytic membrane cell for the production of potassium hydroxide from aqueous solutions of potassium chloride by maintaining the anolyte concentration of potassium chloride at 250 to 350 grams per liter and the catholyte concentration of potassium hydroxide from about 410 to about 480 grams per liter. The electrolytic cell employs an unmodified permselective membrance comprised of a copolymer of a perfluoroolefin and a fluorosulfonate. However, a catholyte current efficiency of 87 percent maximum was achieved at a concentration of potassium hydroxide of about 450 grams potassium hydroxide per liter.

U.S. Pat. No. 4,065,366, issued to Yoshio Oda et al on Dec. 27, 1977, discloses a process for improving the catholyte current efficiency in an electrolytic membrane cell for the production of potassium hydroxide from aqueous solutions of potassium chloride by maintaining the anolyte concentration of potassium chloride at about 155 grams per liter and the catholyte concentration of potassium hydroxide from about 460 to about 555 grams per liter. The electrolytic cell employs a fluorinated cation exchange membrane comprised of a fluorinated copolymer having carboxylic acid groups as the ion exchange group and having an ion exchange capacity of about 0.5 to about 2.0 meq/g/day polymer and a concentration of carboxylic acid groups of about 8 to about 30 meq/g based on water absorbed by the membrane when contacted with an aqueous solution of the alkali metal hydroxide having about the same concentration of alkali metal hydroxide as that of catholyte during electrolysis. A catholyte current efficiency of about 94 percent maximum was achieved at a concentration of potassium hydroxide of about 555 grams potassium hydroxide per liter.

There is a need for an electrolytic membrane process for producing high purity potassium hydroxide at high KOH concentrations with significantly improved current efficiencies using concentrated potassium chloride brine.

OBJECTS

It is a primary object of this invention to provide an improved electrolytic process having a high current efficiency and reduced cell voltage for preparing potassium hydroxide.

It is another object of the present invention to provide a process for producing chlorine gas, hydrogen gas and potassium hydroxide with reduced energy costs.

A further object of the present invention is to provide a process for producing potassium hydroxide of a high purity.

These and other objects of the invention will become apparent from the following description and the appended claims.

BRIEF DESCRIPTION OF THE INVENTION

The aforementioned and other objects are achieved in an electrolytic membrane cell for the production of potassium hydroxide by employing in combination:

(a) a membrane comprised of a carboxylic acid substituted polymer prepared by reacting a fluorinated olefin with a comonomer having a functional group selected from the group consisting of carboxylic acid and a functional group which can be converted to carboxylic acid;

(b) a potassium chloride brine feed through the anolyte chamber of the cell having a concentration in the range from about 250 to about 300 grams of potassium chloride per liter;

(c) a cell operating temperature in the range from about 90 to about 100° C.;

(d) producing a depleted brine in the anolyte chamber after electrolysis in which the potassium chloride consumed by electrolysis ranges from about 5 to about 15 percent by weight of the potassium chloride originally present in the brine feed, and (e) maintaining a catholyte potassium hydroxide concentration in the range from about 500 to about 600 grams potassium hydroxide per liter.

DETAILED DESCRIPTION OF THE INVENTION

The electrolytic cell employed in this invention may be a commercially available or a custom-built electrolytic cell of a size and electrical capacity capable of economically producing the desired potassium hydroxide product.

A particularly advantageous electrolytic cell which may be employed in the practice of this process has separate anolyte and catholyte chambers, using as a separator a selected permselective cation exchange membrane. Located on one side of the membrane partition, the anolyte chamber has an outlet for by-product chlorine gas generated, and an inlet and an outlet for charging, removing, or circulating potassium chloride solution. On the opposite side of the membrane partition, the catholyte chamber has an inlet for water, an outlet for removing potassium hydroxide product and an outlet for removing by-product hydrogen liberated at the cathode by the electrolysis of water.

A gas disengaging space is generally located in each of the anolyte and catholyte chambers within the electrolytic cell.

The membrane cell can be operated on a batch or flow-through system. In the latter system, anolyte and catholyte are continuously circulated to and from external solution storage vessels.

Hydrogen gas is removed as formed from the catholyte chamber and collected for use as a fuel or otherwise disposed of. Any excess chlorine gas is likewise removed as formed from the anolyte chamber and collected.

Typical electrochemical cells which may be employed in the preparation of aqueous solutions of potassium hydroxide are disclosed in U.S. Pat. No. 4,062,743, supra, and hereby incorporated by reference in its entirety.

Materials suitable for use as membranes in the process of this invention include carboxylic acid substituted polymers described in U.S. Pat. No. 4,065,366, supra. The teaching of that patent is incorporated herein in its entirety by reference.

The carboxylic acid substituted polymers of U.S. Pat. No. 4,065,366, supra, are prepared by reacting a fluorinated olefin with a comonomer having a carboxylic acid group or a functional group which can be converted to a carboxylic acid group.

The fluorinated olefin monomers and the comonomers having carboxylic acid group or a functional group which can be converted to carboxylic acid group for using the production of the copolymer for the membranes can be selected from the defined groups below.

It is preferable to use monomers for forming the units (a) and (b) in the copolymers.

$$\text{(a)}\quad \left(CF_2-CXX'\right)$$

$$\text{(b)}\quad \left(CF_2-\underset{\underset{Y}{|}}{C}-X\right)$$

wherein X represents —F, —Cl, —H or $-CF_3$ and X' represents —F, —Cl, —H, $-CF_3$ or $CF_3(CF_2)_m-$; m represents an integer of 1 to 5 and Y represents —A, —ϕ—A, —P—A, $-O-(CF_2)_n(P,Q,R-A$; P represents $-CF_2)_a(CXX')_b(CF_2)_c$; Q represents $-CF_2-O-CXX')_d$; R represents $-CXX'-O-CF_2)_e$; (P,Q,R) represents a discretional arrangement of at least one of P, Q and R; ϕ represents phenylene group; X,X' are defined above; n=0 to 1; a, b, c, d and e represent 0 to 6; A represents —COOH or a functional group which can be converted to —COOH by hydrolysis or neutralization such as —CN, —COF, $-COOR_1$, —COOM, $-CONR_2R_3$; $R_1$ represents a $C_{1-10}$ alkyl group; M represents an alkali metal or a quaternary ammonium group and $R_2$ and $R_3$, respectively, represent hydrogen or a $C_{1-10}$ alkyl group.

The typical groups of Y have the structure having A connected to carbon atom which is connected to a fluorine atom, and include $$\left(CF_2\right)_x-A,\quad -O\left(CF_2\right)_x-A,\quad -O-CF_2-\underset{\underset{Z}{|}}{CF}\Big)_y-A,$$

$$\left(O-CF_2-\underset{\underset{Z}{|}}{CF}-\right)_x\left(O-CF_2-CF\right)_y-A,$$

$$-O-CF_2\left(\underset{\underset{Z}{|}}{CF}-O-CF_2\right)_x\left(CF_2\right)_y\left(CF_2-O-\underset{\underset{R_f}{|}}{CF}\right)_x-A;$$

wherein x, y and z, are respectively, 1 to 10; Z and $R_f$ respectively, represent —F and a $C_{1-10}$ perfluoroalkyl group A is as defined above. In the case of the copolymers having the units (a) and (b), it is preferable to have 1 to 40, especially 30 to 20 mole percent of the unit (b) in order to produce the membrane having an ion-exchange capacity in said range. The molecular weight of the fluorinated copolymer is important because it relates to the tensile strength, the fabricapability, the water permeability and the electrical properties of the resulting fluorinated cation exchange membrane.

Typical carboxylic acid polymers include copolymer of tetrafluoroethylene and $$CF_2=CFO-CF_2=\underset{\underset{CF_3}{|}}{CF}-O(CF_2)_3-COOCH_3$$

prepared with a catalyst of azobisisobutyronitrile in trichlorotrifluoroethane to obtain a fluorinated copolymer having an ion exchange capacity of about 1.17 meq/g polymer and a $T_g$, glass transistion temperature, of 190° C. press-molded to form a film about 200 microns thick and thereafter hydrolyzed in an aqueous methanol solution of sodium hydroxide, (b) a copolymer of tetrafluoroethylene and $CF_2=CFO-(CF_2)_3-COOCH_3$ copolymerized with a catalyst of azobisisobutyronitrile to obtain a fluorinated copolymer having an ion exchange capacity of about 1.45 meq/g polymer and a $T_g$ of about 235° C., press-molded to form a film of thickness about 200 microns and hydrolized in aqueous methanol of sodium hydroxide, (c) a copolymer of tetrafluoroethylene and $$CF_2=CFO-(CF_2)_3COOCH_3 \qquad \text{(A)}$$

$$CF_2=CFOCF_2CF(CF_3)O(CF_2)_3COOCH_3 \qquad \text{(B)}$$

copolymerized with a catalyst of azobisisobutyronitrile (mole ratio A/B of about 4:1) to obtain a fluorinated copolymer having an ion exchange capacity of about 1.45 meq/g polymer and $T_g$ of about 220° C., press-molded to obtain a film of about 200 microns thickness, and hydrolyzed in an aqueous solution of methanol of sodium hydroxide, and (d) a copolymer of tetrafluoroethylene and $CF_2=CFO(CF_2)_3COOCH_3$ were copolymerized with a catalyst of ammonium persulfate in water to obtain a fluorinated copolymer having an ion-exchange capacity of 1.20 meq/g polymer and $T_g$ of 210° C., the copolymer extruded to obtain a film having a thickness of 250 microns and width of 15 centimeters and plied to a cloth made of a copolymer of tetrafluoroethylene and ethylene (50 mesh:thickness 150 microns), compress-molded to form a reinforced film and hydrolyzed in an aqueous methanol solution of sodium hydroxide to obtain a carboxylic acid type fluorinated cation exchange membrane.

For selected laminated membranes, a laminated inert cloth supporting fabric may be employed. The thickness of the laminated inert cloth supporting fabric is in the range from about 3 to about 7 and preferably from about 4 to about 5 mils. The inert supporting fabric is typically comprised of polytetrafluoroethylene, rayon, or mixtures thereof.

At least one electrode is positioned within the anolyte chamber and one electrode within the catholyte chamber. For maximum exposure of the electrolytic surface, the face of the electrode should be parallel to the plane of the membrane.

Examples of materials which may be employed as an anode include commercially available platinized titanium, platinized tantalum, or platinized platinum electrodes which contain, at least on the surface of the electrodes, a deposit of platinum on titanium, platinum on tantalum or platinum on platinum. Also effective are anodes composed of graphite, or anodes comprised of a metal oxide coated substrate such as ruthenium dioxide or titanium and others as described in U.S. Pat. No. 3,632,498, issued to H. B. Beer on Jan. 4, 1972 which is incorporated herein in its entirety by reference. When such electrodes are employed as anodes, anodic chlorine overvoltage is minimized. Any electrode construction capable of effecting electrolytic production of potassium hydroxide from a brine containing a potassium chloride may be employed in the process of this invention.

Examples of materials which may be employed as the cathode are carbon steel, stainless steel, nickel, nickel molybdenum alloys, nickel vanadium alloys, mixtures thereof and the like. Any cathode material that is capable of effecting the electrolytic reduction of water with either high or low hydrogen overvoltage may be used as cathode construction material in the process of this invention.

The cathode and anode may each be of either solid, felt, mesh, foraminous, packed bed, expanded metal, or other design. Any electrode configuration capable of effecting anodic electrolytic production of potassium hydroxide from a brine containing potassium chloride may be used as anodes or cathodes, respectively, in the process of this invention.

The distance between an electrode, such as the anode or the cathode, to the membrane is known as the gap distance for that electrode. The gap distance of the anode to membrane and the cathode to membrane are independently variable. Changing these respective distances concurrently or individually may affect the operational characteristics of the electrolytic cell and is reflected in the calculated current efficiency. For the process of this invention for each electrode, the electrode current efficiency is defined as the ratio of the number of chemical equivalents of product formed divided by the electrical equivalents consumed in forming that product×100. This may be expressed mathematically by the following equation (1):

$$\% \text{ Current Efficiency} = \frac{A/B}{C/D} \times 100 \quad (1)$$

where

A=Mass of product produced in grams.

B=Equivalent weight of product produced in grams per equivalent.

C=Quantity of electricity consumed in making desired product in ampere hours.

D=Faraday's Constant of 26.81 ampere hours per equivalent.

In general, preferably anode to membrane and preferably cathode to membrane gap distances can be defined for any concentration of potassium chloride employed as the anolyte in the membrane electrolytic cell. When using potassium chloride brine solution as the anolyte, the preferable anode to membrane gap distance is in the range from about 0.1 to about 2.54 centimeters, and the preferable cathode to membrane gap distance is in the range from about 0.1 to about 1.7 centimeters.

The anolyte is comprised of an aqueous mixture of potassium chloride. The brine charged to the electrolytic cell may be made by dissolving solid potassium chloride in water, preferably deionized water, or the brine may be obtained from naturally occurring brines. Minor amounts of sodium chloride, sodium bromide, potassium bromide, or mixtures thereof may be present. The concentration of potassium chloride ranges from about 250 to about 300 and preferably from about 270 to about 285 grams of potassium chloride per liter.

The aqueous solution of potassium chloride described above is supplied to the anolyte chamber of the electrolytic cell at a concentration described above and at a flow rate in the range from about 5 to about 20 milliliters per minute.

In starting up an electrolytic cell employing a selected permselective membrane of the type previously described, the cell is first assembled employing the selected membrane. Potassium chloride brine at the desired concentration is charged to the anolyte chamber which is then filled with the brine. An aqueous solution of alkali metal hydroxide such as potassium hydroxide, sodium hydroxide or mixtures thereof of the desired concentration is introduced into the catholyte chamber before starting electrolysis. In the operation of the process of this invention, a direct current is supplied to the cell and a voltage of about 3.8 volts is impressed across the cell terminals. To initially obtain the desired concentration of potassium hydroxide, little or no alkali metal hydroxide such as potassium hydroxide solution may be withdrawn from the catholyte chamber until the desired concentration is obtained.

Alternatively, the catholyte chamber is filled with deionized water prior to the start of electrolysis. U.S. Pat. No. 4,062,743, supra, discloses general methods for starting up electrolytic cells employing alkali metal brines such as potassium chloride brine. During electrolysis, a portion of the spent potassium chloride solution is removed from the anolyte chamber of the cell after partial depletion. The spent solution is treated and reconstituted with fresh chloride brine to the desired feed potassium chloride concentration and then recycled to the cell anolyte chamber for electrolysis.

The rate of which potassium chloride solution is supplied to the anolyte chamber during electrolysis is in the range from about 2 to about 20 and preferably from about 5 to about 8 milliliters per minute at a current density of about 2 kiloamperes per square meter.

A depleted brine is produced in the anolyte chamber after electrolysis in which the potassium chloride consumed by electrolysis ranges from about 5 to about 15 and preferably from about 5 to about 10 percent by weight of the potassium chloride originally present in the brine feed.

The operating voltage of the cell is in the range from about 3.6 to about 3.9 and preferably from about 3.75 to about 3.85 at about 2 $KA/m^2$ current density.

When employing a cell with a carboxylic acid substituted polymer as in the present invention, potassium ions are transported across the membrane from the anolyte chamber into the catholyte chamber. The concentration of potassium hydroxide produced in the catholyte chamber is essentially determined by the amount of any water added to this chamber from a source exterior to the cell and from any water transferred through the permselective membrane.

In a preferred embodiment, the catholyte KOH concentration is maintained within the desired range by introducing water into the catholyte chamber at a rate of about 0.05 to about 0.2 milliliter per minute per kiloampere per square meter of cathode surface. The amount of water added is related to controlling the concentration of the potassium hydroxide in the catholyte, which, in turn, effects the ion transport properties of the membrane.

The electrolysis of the potassium chloride brine is conducted at current densities of from about 1.0 to about 5.0, and preferably from about 1.5 to about 2.5 kiloamperes per square meter of anode working surface.

The operating temperature of the membrane cell is in the range from about 87° to about 110° C., and preferably of about 90° to about 100° C.

The operating pressure of the cell is essentially atmospheric. However, sub- or superatmospheric pressures may be used, if desired.

The catholyte, potassium hydroxide solution, should be removed from the electrolytic cell at a concentration in the range from about 460 to about 700 and preferably from about 500 to about 600 grams potassium hydroxide per liter.

After removal from the cell, the potassium hydroxide solution may be used as is or may be further processed as by further distilling the high concentration to a greater concentration still.

The concentration of salt such as potassium chloride in the KOH of the catholyte chamber is minimal and is generally less than about 0.1 weight percent KCl. This minimal amount of salt such as KCl migrates from the anolyte chamber where it is fed to the cell as an electrolysis reactant, to the catholyte chamber through the carboxylic acid substituted permselective membrane.

Chlorine gas produced in the anolyte chamber and hydrogen gas produced in the catholyte chamber are recovered from the cell as formed and are recovered by well-known methods.

U.S. Pat. No. 4,115,240, issued to Tatsuro Asawa et al on Sept. 19, 1978, discloses when the electrolysis is continued for a long time, on carboxylic acid substituted polymers of the type employed in this invention, the electrochemical properties such as the current efficiency and the cell voltage of the cation exchange membrane of the carboxylic acid type fluorinated polymer are gradually deteriorated. The reason is not clear, however, it has been considered that the deterioration of the electrochemical properties has been caused by a change of mechanical property and a precipitation of sparingly soluble calcium and magnesium hydroxides on or in the membrane under the condition of the electrolysis.

That patent also teaches the electrochemical properties of the carboxylic acid type fluorinated polymer may be recovered by converting ion exchange groups of $+COO)_n—M$; where M represents an alkali metal or an alkaline earth metal; and M represents a value of M; to the corresponding acid or ester group of —COOR wherein R represents hydrogen or a $C_1$–$C_5$ alkyl group and heat treating the fluorinated polymer having the groups of —COOR. The teachings of that patent are incorporated herein in its entirety by reference.

The following examples are present to define the invention more fully without any intention of being limited thereby. All parts and percentages are by weight unless indicated otherwise.

EXAMPLE 1

Potassium hydroxide, hydrogen gas and chlorine gas were continuously prepared in a divided flow-through polytetrafluoroethylene cell having an anolyte chamber containing an anode and a catholyte chamber containing a cathode and exterior dimensions which were about 23 centimeters in height, about 13 centimeters in width, and about 9 centimeters in depth. A carboxylic acid substituted polymer as described below was employed to separate the catholyte chamber and the anolyte chamber.

An anode was positioned vertically in the anolyte chamber. The anode was a 2¾ inch by 2¾ inch section of metallic mesh comprised of a titanium substrate coated with a mixed oxide of ruthenium oxide and titanium oxide. The coating was obtained by painting the titanium substrate with butyl titanate and ruthenium trichloride and then oven fired to form the oxides. The finished anode was of the type described in U.S. Pat. No. 3,632,498, supra, was secured on one side to a 5/16 inch diameter circular titanium rod centrally inserted through one side of the anolyte chamber.

A cathode was positioned vertically in the catholyte chamber. The cathode was 2¾ inch by 2¾ inch section of nickel wire mesh. The cathode mesh was secured on one side to 5/16 inch diameter circular nickel rod which extended into the catholyte chamber through the opposite side wall of the catholyte chamber.

The membrane employed was a carboxylic acid substituted polymer of the type described in U.S. Pat. No. 4,065,366, supra, prepared by reacting a fluorinated olefin with a functional group which was converted to a carboxylic acid group.

The membrane was soaked for about 16 hours in about a 25 percent by weight aqueous sodium hydroxide solution which was maintained at a temperature of about 85° C.

Thereafter, the membrane was removed from the sodium hydroxide solution and while still damp with the sodium hydroxide solution was placed in the cell.

The membrane was positioned vertically in the center of the cell and formed a catholyte chamber which was about 7.6 centimeters in width, about 1.7 centimeters in depth, and about 17.8 centimeters in height and an anolyte chamber which was about 7.6 centimeters in width, about 1.9 centimeters in depth, and about 17.8 centimeters in height.

Both anode and cathode were positioned parallel to the cell membrane. The anode to membrane gap distance was set at about 0.3 centimeter and the cathode to membrane gap distance was set at about 0.3 centimeter. The cell was fully assembled.

A saturated potassium chloride solution was fed to the anolyte chamber at about 12 milliliters per minute. The catholyte chamber was filled with deionized water. Thereafter, deionized water was supplied to the catholyte chamber at a flow rate of about 0.2 milliliter per hour. The cell temperature was maintained at about 70° C. The cell current was about 0.5 ampere. The above conditions were maintained for about 16 hours.

Thereafter, the current was increased to a final current density of about 2 kiloamperes per meter square. The cell operating temperature was increased to about 87°.

During electrolysis, the anolyte solution was continuously supplied at a controlled rate to the anolyte chamber of the electrolytic cell by means of regulating the flow from a head tank of anolyte solution. A receiving tank was connected to the outlet process connection on the anolyte chamber to collect depleted potassium chloride brine for treatment, regeneration and subsequent reuse as feed potassium chloride to the electrolytic cell. In addition, a storage flask was connected to the outlet process connection on the catholyte chamber to collect product potassium hydroxide. A source of deionized water was connected to a process inlet of the catholyte chamber. The vapor outlet of the anolyte chamber was connected to a vented scrubber to collect chlorine generated in the anolyte chamber of the cell. Hydrogen generated in the catholyte chamber of the cell was collected in a process hydrogen header system.

The anolyte chamber was filled with a concentrated potassium chloride brine containing about 280 grams potassium chloride per liter of solution. The catholyte chamber was filled with an aqueous solution of sodium hydroxide containing about 30 percent sodium hydroxide by weight.

After electrolysis was started in the cell, and the concentration of KOH in the catholyte was in the range from about 500 to about 600 grams KOH per liter of solution, deionized water was supplied to the catholyte chamber at about 0.35 milliliter per minute.

The portion of the catholyte containing the sodium hydroxide employed during start-up of the cell was collected and segregated from product potassium hydroxide.

The concentration of potassium chloride in the brine supplied to the electrolytic cell for electrolysis was about 280 grams potassium chloride per liter of solution and was supplied to the cell at a volumetric flow rate of about 12 milliliters per minute.

Spent potassium chloride was continuously removed from the anolyte chamber and had a concentration of about 263 grams potassium chloride per liter of solution. The percent of KCl utilized in the potassium chloride brine fed to the cell was about 6.1 percent.

The operating temperature of the cell was maintained at about 90° C. and the operating pressure of the cell was about atmospheric. Cell voltage was about 3.7 volts.

After about twenty-four hours (about 250 ampere hour of electrical energy), electolysis was stopped. During that time, about 1250 grams of potassium hydroxide solution having a concentration of 585 grams KOH per liter was prepared. The cell current efficiency was calculated using equation (1) on the basis of the potassium hydroxide produced and was calculated to be about 98.8 percent.

Table I, below, illustrates selected operating conditions and calculated catholyte current efficiencies for a series of similar examples (2–7) of electrolysis of potassium chloride brine solutions employed to prepare aqueous solutions of KOH of varying concentrations employing the previously described electrolytic cell and carboxylic acid substituted polymer.

TABLE II

Electrolysis of KCl Brine at a Current Density of About 2 KA/M$^2$ at About 90° C. Using Carboxylic Acid Membrane

| Example | 2 | 3 | 4 | 5 | 6 | 7 |
|---|---|---|---|---|---|---|
| Water (mls per minute) | 0.25 | 0.2 | 0.2 | 0.2 | 0.2 | 0.2 |
| Voltage (volts) | 3.9 | 3.8 | 3.8 | 3.9 | 3.9 | 3.7 |
| Feed KCl concentration (grams per liter) | 280 | 280 | 280 | 280 | 280 | 280 |
| Spent KCl concentration (grams per liter) | 255 | 267 | 265 | 265 | 268 | 247 |
| Product KOH Concentration (grams per liter) | 500 | 532 | 551 | 575 | 587 | 603 |
| Catholyte Current Efficiency (%) | 96.2 | 97.1 | 96.4 | 96.8 | 98.2 | 97.4 |
| Percent depletion of KCl in KCl Brine fed to cell | 8.9 | 4.6 | 5.4 | 5.4 | 4.3 | 11.8 |

COMPARATIVE EXAMPLE A

An electrolysis of an aqueous solution of KCl was carried out by employing a carboxylic acid type fluorinated cation exchange membrane prepared by hydrolyzing a copolymer of $C_2F_4$ and $CF_2{=}CFOCF_2CF(CF_3){-}OCF_2CF_2COOCH_3$. The membrane had about 1.28 meq/g ion exchange groups per 1 gram of dry polymer and about 23.6 meq/g ion exchange groups on the base of the water absorbed in the membrane in 35 weight percent NaOH and had an area of about 0.25 decimeter squared.

The anode was comprised of titanium coated with rhodium. The cathode was comprised of stainless steel. The distance between the cathode and the anode was about 2.2 centimeters.

In the elctrolysis, KCl at a concentration of about 270 gram per liter was fed into the anode chamber and water was fed into the catholyte chamber to form an aqueous KOH solution containing about 555 grams KOH per liter. The electrolysis was carried out at 85° C. under the current 5 amperes and a current density of 20 amperes per decimeter squared. The concentration of KCl aqueous solution overflowed from the anode chamber was about 155 grams KCl per liter. The cell voltage was about 4.3 volts and the current efficiency was about 94.3% and the percent of KCl depleted in the potassium chloride brine fed to the cell was about 45 percent during electrolysis.

A comparison of these results with Examples 1–7 shows that the catholyte current efficiency for the electrolysis of KCl by the process of this invention as shown in Examples 1–7 was about 96.6 to about 98.8 percent in a KOH concentration range of about 500 to about 603 rams KOH per liter at about 90° C., and utilizing about 5–15 percent of the KCl present in the potassium chloride brine fed to the anolyte chamber of the electrolytic cell during electrolysis at a cell voltage of about 3.7 volts.

In marked contrast, the catholyte current efficiency of Comparative Example A was about 94.3 percent at a concentration of about 555 grams KOH per liter, at about 85° C., and utilized about 45% of the KCl in the potassium chloride brine fed to the anolyte chamber of the electrolytic cell during electrolysis at a cell voltage of about 4.3 volts.

Thus, it can be seen that the catholyte current efficiency of the process of this invention is at least two and generally as high as 4.5 percentage points greater than the catholyte current efficiency of the methods of the prior art, while the cell voltage is about 0.6 volts lower.

What is claimed is:

1. A process for the production of potassium hydroxide in an electrolytic membrane cell by employing in combination:

(a) a membrane comprised of a carboxylic acid substituted polymer prepared by reacting a fluorinated olefin with a comonomer having a functional group selected from the group consisting of carboxylic acid and a functional group which can be converted to carboxylic acid;

(b) a potassium chloride brine feed through the anolyte chamber of the cell having a concentration in the range from about 250 to about 300 grams of potassium chloride per liter;

(c) a cell operating temperature in the range from about 90 to about 100° C.;

(d) producing a depleted brine in the anolyte chamber after electrolysis in which the potassium chloride consumed by electrolysis ranges from about 5 to about 15 percent by weight of the potassium chloride originally present in the brine feed, and, (e) maintaining a catholyte potassium hydroxide concentration in the range from about 500 to about 600 grams potassium hydroxide per liter.

2. The process of claim 1, wherein said carboxylic acid substituted polymer is a copolymer of tetrafluoroethylene and $$CF_2{=}CFO{-}CF_2{=}\underset{\substack{|\\ CF_3}}{CF}{-}O(CF_2)_3{-}COOCH_3$$

prepared with a catalyst of azobisisobutyronitrile in trichlorotrifluorethane to obtain a fluorinated copolymer having an ion exchange capacity of about 1.17 meq/g polymer and a $T_g$ of 190° C. press molded to form a film about 200 microns thick thereafter hydrolyzed in an aqueous methanol solution of sodium hydroxide.

3. The process of claim 1, wherein said carboxylic acid substituted polymer is a copolymer of tetrafluoroethylene acid $CF_2{=}CFO{-}(CF_2)_3{-}COOCH_3$ copolymerized with a catalyst of azobisisobutyronitrile to obtain a fluorinated copolymer having an ion exchange capacity of about 1.45 meq/g polymer and a $T_g$ of about 235° C., press molded to form a film of thickness about 200 microns, hydrolyzed in aqueous methanol of sodium hydroxide.

4. The process of claim 1, wherein said carboxylic acid substituted polymer is a copolymer of tetrafluoroethylene and $CF_2{=}CFO{-}(CF_2)_3COOCH_3$ (A) and $CF_2{=}CFOCF_2CF(CF_3)O(CF_2)_3COOCH_3$ (B) copolymerized with a catalyst of azobisisobutyronitrile (mole ratios A/B of about 4:1) to obtain a fluorinated copolymer having an ion exchange capacity of about 1.45 meq/g polymer and $T_g$ of about 220° C., press molded to obtain a film of about 200 microns thickness, and hydrolyzed in an Aqueous solution of methanol of sodium hydroxide.

5. The process of claim 4, wherein said carboxylic acid substituted acid polymer is a copolymer of tetrafluoroethylene and $CF_2{=}CFO(CF_2)_3{=}COOCH_3$ with a catalyst of ammonium persulfate in water to obtain a fluorinated copolymer having an ion-exchange capacity of 1.20 meq/g polymer and $T_g$ of 210° C. The copolymer extruded to obtain a film having a thickness of 240 microns and width of 15 cm, and plied to a cloth made of copolymer of tetrafluoroethylene and ethylene (50 mesh:thickness 150 microns) compress-molded to form a reinforced film and hydrolyzed in an aqueous methanol solution of sodium hydroxide to obtain a carboxylic acid type fluorinated cation exchange membrane.

6. The process of claims 2,3,4, or 5, wherein said electrolytic cell is operated at a temperature in the range from about 90° C. to about 95° C.

7. The process of claim 6, wherein said potassium chloride present in the potassium chloride brine fed to said cell is depleted in the range from about 5 to about 10 percent during electrolysis.

* * * * *